United States Patent [19]

Kuah

[11] Patent Number: 4,721,435

[45] Date of Patent: Jan. 26, 1988

[54] FLUID FLOW CONTROL MEANS FOR PUMPS AND THE LIKE

[75] Inventor: Leong P. Kuah, Pomona, Calif.

[73] Assignee: Borg-Warner Industrial Products, Long Beach, Calif.

[21] Appl. No.: 857,666

[22] Filed: Apr. 30, 1986

[51] Int. Cl.[4] ..... F04D 13/12

[52] U.S. Cl. ..... 415/143; 415/208; 415/183

[58] Field of Search ..... 415/143.53 R, 74, 208, 415/216, 217, 218, 189, 190, 191, 182, 183, DIG. 1

[56] References Cited

U.S. PATENT DOCUMENTS

| | | | |
|---|---|---|---|
| 1,094,836 | 4/1914 | De Laval | 415/187 |
| 1,504,746 | 8/1924 | De Wein | 415/183 |
| 1,719,090 | 7/1929 | Stillman | 415/183 |
| 1,966,787 | 7/1934 | Buri | 415/142 |
| 2,311,896 | 2/1943 | Criqui | 415/217 |
| 3,143,103 | 8/1964 | Zuhn | 415/199.6 |
| 3,384,022 | 5/1968 | Oshima | 415/143 |
| 4,111,597 | 9/1978 | Grossi et al. | 415/143 |
| 4,375,937 | 3/1983 | Cooper | 415/143 |
| 4,585,391 | 4/1986 | Vuillet et al. | 415/DIG. 1 |

FOREIGN PATENT DOCUMENTS

| | | | |
|---|---|---|---|
| 128998 | 7/1984 | Japan | 415/217 |
| 792369 | 3/1958 | United Kingdom | 415/217 |
| 635284 | 11/1978 | U.S.S.R. | 415/199.6 |
| 714049 | 2/1980 | U.S.S.R. | 415/DIG. 1 |
| 1195068 | 11/1985 | U.S.S.R. | 415/DIG. 1 |

*Primary Examiner*—Robert E. Garrett
*Assistant Examiner*—John T. Kwon
*Attorney, Agent, or Firm*—Aubrey L. Burgess

[57] ABSTRACT

A fluid machine including a device disposed in the inlet passage of the fluid machine for retarding pump cavitational surging at low flow rates. The device includes an annulus assembly having a series of curved radially disposed vanes for capturing fluid backflowing from the pumping chamber and redirecting same toward the center of the inlet passageway.

12 Claims, 3 Drawing Figures

FLUID FLOW CONTROL MEANS FOR PUMPS AND THE LIKE

FIELD OF THE INVENTION

This invention relates to fluid machinery and, more particularly, to a device designed to substantially retard cavitation surging within such machinery.

BACKGROUND OF THE INVENTION

As a skilled artisan may appreciate, fluid machines such as pumps, which operate over a wide range of capacities, are subjected to cavitation surges at low flow rates and at moderate to low values of Net Positive Suction Head (NPSH). A flow rate of less than about 50% of the pump's design flow rate may be considered a low flow rate. Moderate to low values of Net Positive Suction Head (NPSH) are generally those that produce a pump pressure rise reduction of 1% to 3% below the pressure rise obtained in the absence of NPSH influence.

When cavitation and recirculation exist simultaneously, cavitation in the pump suction or intake can, and often does, surge far upstream. Such surges often create vibrations characterized by low frequency shuttling. These vibrations, in turn, may cause numerous mechanical problems, i.e., bearing failure, seal failure, and etc. As is evidenced from the art, several attempts at reducing pump cavitation have been made.

U.S. Pat. Nos. 3,504,986; 4,375,937; and, 4,375,938 disclose various pump housings having fluidic passageways provided therein for capturing recirculating fluids in a manner reducing pump cavitation surge.

U.S. Pat. Nos. 3,384,022; 3,664,759; 4,150,916; and, 4,239,453 disclose pumps having various restriction means disposed within the pump inlet passageway for redirecting backflowing fluids in a manner reducing pump cavitation surge.

SUMMARY OF THE INVENTION

This invention pertains to a fluid machine having a housing including a pumping chamber and conduit means leading from the exterior of the fluid machine to the pumping chamber. A rotodynamic means such as an impeller may be provided within the pumping chamber for pumping fluid by centrifugal force. If the pump means or impeller is operated at flow rates much less than optimum efficiency point, a swirling fluid may eminate backflow from the pumping chamber. This backflowing fluid usually forms a fluid boundary layer about the fluid flowing toward the pumping chamber.

The present invention is not intended to prevent the pump for cavitating. Instead, the apparatus of the present invention suppresses the cavitational surge in the pump intake. With the present invention, operative means, disposed upstream of the impeller and within the conduit means, collects sufficient backflowing fluid and redirects same into the inward flow whereby preventing cavitation surging of the pump. Unlike other devices, the operative means of the present invention requires minimal changes to the pump housing. In contrast to some devices, the operative means of the present invention includes an annulus assemblage having a plurality of radially inward extending stationary blades or vanes which are curved to capture the swirling backflowing fluid. The vanes are designed, however, not to restrict or substantially interfere with the inward flowing fluid which is directed toward the pumping chamber. As such, the fluid machine may be operated at flow rates much less than optimum efficiency point without the noise and vibrational characteristics usually associated with such operation.

In accordance with the above, a primary object of this invention is to provide novel means which can be used in combination with fluid machinery for retarding pump cavitation surge whereby reducing an occurrence of noise and vibration over a wide range of fluid flow rates.

Another object of this invention is the provision of suitable means which can redirect a fluid counterflow produced at the suction side of a fluid machine without substantially interfering with ordinary fluid flow.

Another object of this invention is to provide novel means adapted for use combination with fluid machinery for retarding pump cavitation surge but which requires minimal changes to the pump housing.

Yet another object of this invention is to provide means for retarding pump cavitation surge which is simple in construction and inexpensive.

DESCRIPTION OF THE DRAWING

Having in mind the above objects and other attendant advantages that would be evident from an understanding of this disclosure, the invention comprises the devices, combination and arrangement of parts as illustrated in the presently preferred forms of the invention which are hereinafter set forth in detail to enable those skilled in the art to readily understand the function, operation, construction and advantages of same when read in conjunction with the accompanying drawing in which.

DETAILED DESCRIPTION OF THE PRESENT INVENTION

Figure 1:
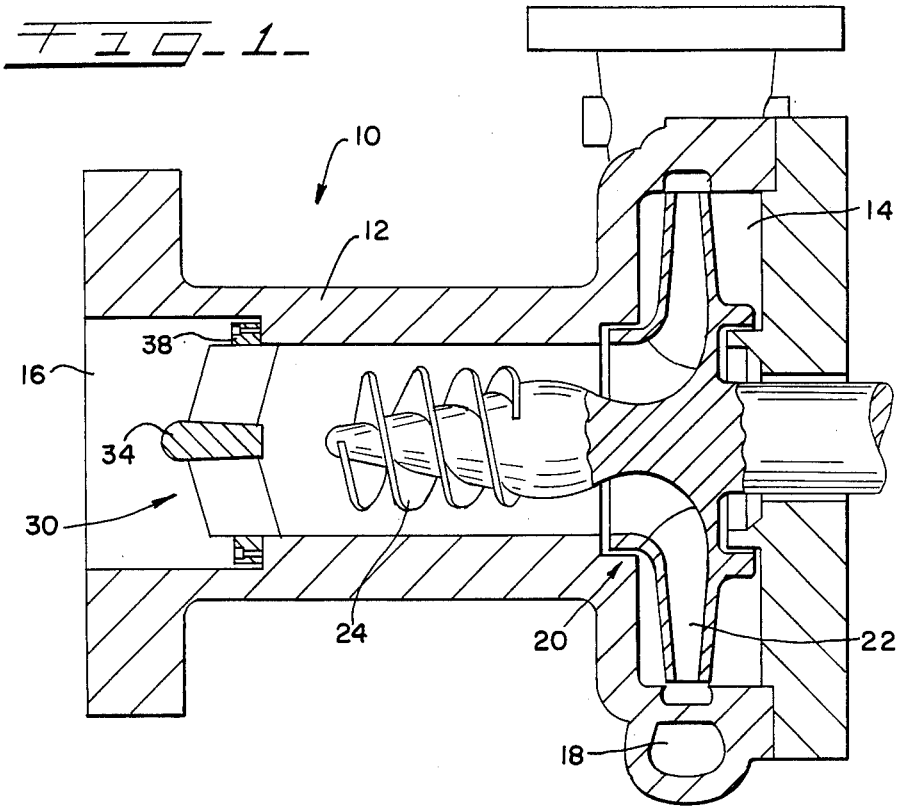
FIG. 1 is a longitudinal sectional view of a fluid machine incorporating one embodiment of the present invention.

Turning now to the drawings, wherein like reference numerals indicate like parts throughout the several views, in FIG. 1 there is illustrated a fluid machine 10 which may be a centrifugal pump or the like. The fluid machine 10 includes a housing or casing 12 having a pumping chamber 14 and which is provided with conduit means 16 and 18 defining confined spaces through which fluid flows. In the illustrated embodiment, conduit 16 acts as a flud suction intake or inlet passageway while conduit 18 acts as an outlet passageway. Rotodynamic means 20 may be rotationally arranged in the pumping chamber 14 in a manner creating fluid flow through said passageways. In the illustrated embodiment, the rotodynamic means includes an impeller 22 and may include an inducer 24 situated upstream from the main impeller 22 and which operates in conjunction therewith.

As is known in the art, the rotodynamic means 20 may be operated over a range of flow rates. When the rotodynamic means is operated at flow rates much less than optimum efficiency point, cavitation surging within the fluid machine may occur. It is believed that cavitation surging of the pump occurs when sufficient liquid backflows from the pumping chamber. That is, there may be fluid flow within the inlet passageway extending in two opposed directions. One fluid flow is directed toward the pumping chamber. The other fluid flow is that fluid backflowing upstream from the pumping chamber. The backflowing liquid is caused at low flow rates since liquid cannot move forward through the pump and, hence, backflows upstream. The rotation of the impeller causes this liquid to swirl upstream as it backflows. The swirling backflowing fluid tends to move outward toward the walls of the confined spaces by means of centrifugal force whereby forming a fluid boundary layer about the fluid flowing toward the pumping chamber. To avoid cavitation surging, the swirling and backflowing fluid must be straightened out and redirected toward the center of the intake opening.

Figure 3:
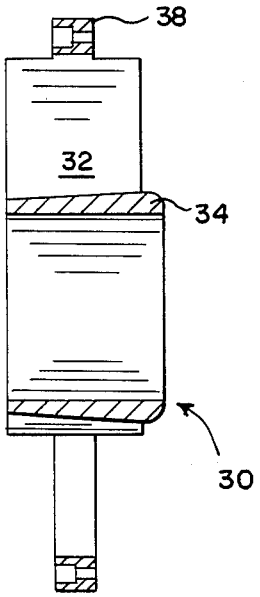
FIG. 3 is a cross-sectional view taken along line 3—3 of FIG. 2.
Figure 2:
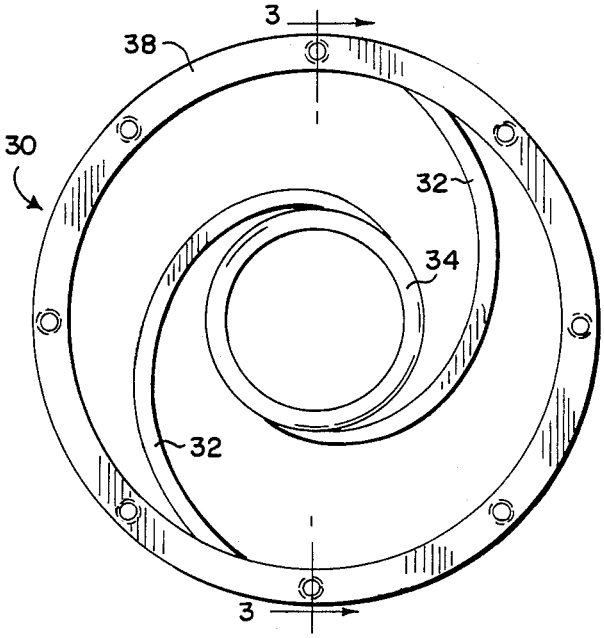
FIG. 2 is an end view of another embodiment of the present invention.

According to the present invention, a backflow retardation device 30 is provided upstream of the impeller 22 and inducer 24 to suppress the cavitation surge. Unlike other devices, the backflow preventer means 30 may be arranged within the confined spaces of the housing without significant changes to the inlet passageway 16. From the depicted embodiment of the backflow retardation device, in FIGS. 2 and 3, it may be seen to include an annulus assembly comprised of a plurality of stationary vanes 32 which radially extend transverse to the centerline of the inlet opening. Each radial vane includes a blade portion extending generally parallel to the inward directional fluid flow but which is also curved in design. The curved design enables the blades 32 to act as a catching means for collecting sufficient backflowing fluid and redirecting same toward the center of the inlet passageway. This design allows for backflowing fluid to be caught without interfering with the incoming flow to the pump chamber and hence without interfering with pump performance.

As apparent from the drawings, the vanes 32 terminate inwardly short of the center of said inlet passageways. The innermost ends of the vanes 32 may be secured to a hub 34 centrally disposed in the passageway 16. The outermost edges of the vanes 32 may be secured to a ring 38 which acts as a securement means for the annulus assembly.

The backflow retardation device 30 according to the invention is capable of collecting sufficient fluid backflow from the impeller and redirecting same into the inlet stream to prevent cavitation surging of the pump. A salient feature of the present invention is that it can accomplish these ends without substantial changes or reworking of the inlet passageway and more importantly the pump housing. Moreover, the present invention effects these desirous ends without adversely effecting the incoming stream of fluid to the pump or the pumps performance.

While the invention has been described in connection with specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims which are attached hereto and form a part hereof.

Thus, having adequately described my invention what I claim is:

1. In combination with a fluid machine adapted to move fluids, said machine including a housing having a pumping chamber, conduit means leading from the housing exterior to said pump chamber, rotodynamic means arranged for rotation in said pumping chamber for creating a fluid flow in a first direction in said conduit means and which, when operated at flow rates much less than optimum efficiency point, causes a swirling fluid backflow in a second direction which forms a fluid boundary layer about fluid flowing toward said chamber, operative means for retarding the cavitational surge effects said backflowing fluid has on said machine operation, said operative means comprising:

a fixedly positioned annulus assembly including a series of radially curved and axially straight blades disposed within said conduit means transversely of the centerline thereof for forcing the swirling and recirculating fluid flow toward the center of said conduit means whereby retarding the cavitational surge effects created thereby and without interfering with the fluid flowing in the first direction, said annulus assembly being independent of and spaced from said rotodynamic means.

2. The invention according to claim 1 wherein each of said blades terminate inwardly short of the center of said conduit means.

3. The invention according to claim 2 further including a hub to which the radial innermost ends of the blades are secured.

4. The invention according to claim 3 further including a mounting ring adapted for securement to said housing and to which each of said blades are secured.

5. In a centrifugal pump comprising:

a housing having a pumping chamber, an inlet arranged on an upstream side of said pumping chamber for directing fluid theretoward, and an outlet leading fluid from said pumping chamber;

rotodynamic means comprsing an impeller disposed in the pumping chamber and a connected inducer upstream thereof for creating an inward flow of fluid directed toward said pumping chamber and wherein swirling fluid backflows upstream; and a plurality of radially curved and axially straight vanes arranged in said inlet upstream of said pumping chamber for redirecting the backflowing swirling fluid toward the center of said inlet, said vanes being fixedly positioned, independent of and spaced from said rototdynamic means.

6. The invention according to claim 5 wherein each of said vanes terminate radially short of the center of said inlet.

7. The invention according to claim 6 further including a hub to which the innermost ends of said vanes are secured.

8. The invention according to claim 5 further including a ring adapted for securement to said housing and to which each of said blades are secured.

9. A centrifugal pump having a housing, a fluid intake passageway arranged in combination with said housing and defining a confined space through which fluid flows in a first direction, a rotary impeller for creating fluid flow through said confined space and which, when operated at less than optimum efficeincy flow rate, causes a swirling backflow of said fluid in said confined space in a second direction, and operative means for retarding pump cavitation surge resulting from the backflow of fluid in said confined space, said operative means comprising:

a plurality of radially curved and axially straight blades fixedly positioned in said confined space upstream of the impeller, said blades being disposed independent of and spaced from said impeller to redirect the fluid backflowing in the second direction in a manner retarding cavitational surging of the pump and without interfering with the fluid flowing in the first direction.

10. The invention according to claim 9 wherein each of said blades terminate inwardly short of the center of said confined space in which the blades are arranged.

11. The invention according to claim 10 further including a hub to which the innermost ends of the blades are secured.

12. The invention according to claim 9 further including a mounting ring adapted for securement to said housing and to which each of said vanes are secured.

* * * * *